US012383781B2

(12) United States Patent
Kofron

(10) Patent No.: US 12,383,781 B2
(45) Date of Patent: Aug. 12, 2025

(54) FITNESS AND REHABILITATION AID

(71) Applicant: Martin Kofron, Rychnovek (CZ)

(72) Inventor: Martin Kofron, Rychnovek (CZ)

( * ) Notice: Subject to any disclaimer, the term of this patent is extended or adjusted under 35 U.S.C. 154(b) by 232 days.

(21) Appl. No.: 18/166,003

(22) Filed: Feb. 8, 2023

(65) Prior Publication Data

US 2023/0191183 A1 Jun. 22, 2023

Related U.S. Application Data

(63) Continuation of application No. PCT/CZ2020/000048, filed on Nov. 6, 2020.

(30) Foreign Application Priority Data

Aug. 25, 2020 (CZ) ..... CZ2020-472

(51) Int. Cl.
*A63B 21/06* (2006.01)

(52) U.S. Cl.
CPC .. *A63B 21/0608* (2013.01); *A63B 2208/0204* (2013.01); *A63B 2214/00* (2020.08); *A63B 2225/09* (2013.01)

(58) Field of Classification Search
CPC ..... A63B 15/00; A63B 21/0004; A63B 21/00058; A63B 21/00061; A63B 21/00065; A63B 21/06; A63B 21/0608; A63B 21/072; A63B 21/0728; A63B 21/075; A63B 21/08; A63B 21/151; A63B 21/4035; A63B 21/4043; A63B 23/02; A63B 23/03508; A63B 23/03516; A63B 23/12; A63B 65/04; A63B 2208/0204; A63B 2214/00; A63B 2225/09; A63B 2244/09; A63B 2244/17
See application file for complete search history.

(56) References Cited

U.S. PATENT DOCUMENTS 3,428,325 A 2/1969 Atkinson
3,653,660 A * 4/1972 Malhas ..... A63B 69/385 206/315.9

(Continued)

FOREIGN PATENT DOCUMENTS

CZ 29869 10/2016
CZ 31071 10/2017

OTHER PUBLICATIONS

Radim Jebavy, Petr Doubravsky; Abstract of "Posilovani s medicinbaly" (translation: "Strengthening with medicine balls" corresponding to publication "Workout with medicine balls" referenced on p. 5 of the present application); 2011; Grada Publishing Czech Republic; 1 page.

*Primary Examiner* — Gary D Urbiel Goldner
(74) *Attorney, Agent, or Firm* — Lipsitz & McAllister, LLC

(57) ABSTRACT

A fitness and rehabilitation aid is provided comprising a weighted loading head for achieving a desired centrifugal force and a handle configured for grasping by a user. The weighted loading head and the handle are interconnected by a flexible connecting component. A length of the flexible connecting component between the weighted loading head and the handle is at least 600 mm. In use, the user grasps the handle and rotates the fitness and rehabilitation aid in a particular pattern, creating the desired centrifugal force to stimulate desired muscle parts of the user.

7 Claims, 10 Drawing Sheets

(56) References Cited

U.S. PATENT DOCUMENTS

| | | | | | |
|---|---|---|---|---|---|
| 3,743,297 | A * | 7/1973 | Dennis | A63B 15/00 | 482/109 |
| 4,444,396 | A * | 4/1984 | Wendt | A63B 15/00 | 482/109 |
| 5,026,063 | A * | 6/1991 | Rhodes | A63B 15/00 | 473/256 |
| 5,058,883 | A | 10/1991 | Dybvik | | |
| 5,577,966 | A * | 11/1996 | Duran | A63B 69/3635 | 473/235 |
| 6,540,649 | B1 | 4/2003 | Niedrich | | |
| 6,887,188 | B1 | 5/2005 | Davies | | |
| 8,172,696 | B2 * | 5/2012 | Lum | A63B 69/3623 | 473/409 |
| 8,540,584 | B1 * | 9/2013 | Sorenson | A63B 69/0002 | 473/219 |
| 9,999,820 | B2 * | 6/2018 | Steenberg | A63B 69/3623 | |
| 10,888,729 | B2 * | 1/2021 | Haines | A63B 21/0601 | |
| 2003/0148859 | A1 | 8/2003 | Chun | | |
| 2004/0002408 | A1 | 1/2004 | Rigas | | |
| 2014/0141943 | A1 | 5/2014 | DiPace et al. | | |
| 2014/0194258 | A1 | 7/2014 | Shorter | | |
| 2020/0086161 | A1 | 3/2020 | Kofron | | |

* cited by examiner

FITNESS AND REHABILITATION AID

CROSS-REFERENCE TO RELATED APPLICATIONS

This application is a continuation application of international application number PCT/CZ2020/000048, filed on Nov. 6, 2020, and claims the benefit of Czech Republic application number PV 2020-472, filed Aug. 25, 2020, which are incorporated herein by reference in their entirety and for all purposes.

TECHNICAL FIELD

The invention concerns fitness and rehabilitation aid intended mainly for working out, body parts forming and rehabilitation both at home and outside.

BACKGROUND ART

There are various known versions of fitness and rehabilitation systems placed in fitness centers or rehabilitation gyms. Generally, these are large systems that are placed in the above-mentioned facilities.

Another solution is a fitness and rehabilitation aid that is easily transportable and enables the exercising person to work more body parts and perform more rehabilitation and fitness exercises that were never used before, as described in the utility model CZ 29869 and the utility model CZ 31071, which is an improved variation of the solution as per CZ 29869. The document CZ 31071 can be described as the closest state of the art, because the herein presented invention is an innovation of solutions as per CZ 29869 and CZ 31071.

This fitness and rehabilitation aid as per CZ 31071 consists of flexible rope equipped with a loading head on one end. By grasping the flexible rope on the opposite end from the loading head, it is possible to perform torsion and rotary movements of torso and upper limbs; with frequent exercising the body parts are shaping up and the muscles of the upper body half are strengthening, mainly abdominals and back muscles. This technical solution is made so that the flexible rope is equipped with handle on the opposite end from the loading head. The handle is preferably equipped with elastic coating. The loading head is also preferably equipped with elastic coating, for example made from soft rubber.

Locking for adjustment of the length of the flexible rope between the loading head and the handle provides easy change of the rope length. However, it was found out that the optimal length of the rope must be defined in certain range for correct exercising, which was not implied in the older document, which has substantial drawbacks that can make the aid less effective or even less safe for use.

At the same time the document does not imply the proper placement of the weight, though the loading head is equipped with weights that can be interchangeably placed by attaching them to the flexible rope, by which the load can be changed during workout. The drawback of this variation arises from the possibility of releasing the weight during exercising, therefore safety is not sufficiently guaranteed. If the weights are interchangeable, it is necessary to store the weights in a suitable place, so it cannot be lost. Furthermore, it is not clear how the weights are organized and how the attachment of the weights is achieved as per document CZ 29869, because it does not provide sufficient guidance for an expert to attach the weight.

These documents also do not state any details regarding the weight of individual parts, i. e. of loading head, and in case of using weights it does not state the ratios of component length to their weight, due to which the aids are ineffective without further clarification.

Another state of the technology document is for example document U.S. Pat. No. 6,540,649 (NIEDRICH DOUGLAS [US]), which describes workout aid that contains a thread that has opposing ends and also the handle attached to one of these opposing ends, while this device is able to resist the movement and is able to induce the movement in reaction to the force affecting the handle.

Also document US 2014/0194258 (SHORTER GARY T [US]) is known, which describes workout device, an innovation of a widely available weight known as kettlebell. Mostly surface muscles are worked out with this weight. Proportions with handles ca. 310 mm and weight over 1 kg without weights are noticeably different from the subject matter invention and in no case can be used as an rehabilitation equipment for strengthening the core muscles and LPHC system on the basis of centrifugal force, which is based on the principle of fitness and rehabilitation equipment. There is an important technological difference in the fact that the rope in this document is not the primary part of the objected equipment and it is noted that it can be used for attachment of the ring intended for the rope. Even in the design only the ring for the rope or cable is drawn. On the contrary, in the solution as per the invention, the rope is an integral part and cannot be detached from the loading head, the equipment works only as a whole and only in exact range of rope lengths and loading head weights. If length and weight are not taken into consideration, the equipment is non-functioning.

Also document US2014141943 (DIPACE DANIEL [US], et al) is known, which describes a portable workout device that can be adjusted for various sports. To be more specific it is an elongated tubular part that contains connectors for attaching various spheres and/or sport devices. The training device is adjustable by various hollow tubes of various sizes and/or diameters that enable to add one or more types of weight materials to the hollow part.

In addition, publication "Workout with medicine balls" (R. Jebavý, P. Doubravský, CZ 2011) is known, which describes equipment which is not primarily used with rope. The medicine balls are made in various sizes and weights that are in the order of kilograms. Due to this fact, this device is not possible to be used for rehabilitation with use of rope. The document describes a swinging movement, which is a basic mistake in rehabilitation; therefore, in this case it is in conflict with the intended use of the aid as per this invention. Due to the weight of the medicine ball expert would not use rope, as such workout would be unbearable, or even physically impossible. If the medicine ball was still tied to a rope, it would be possible to perform very specific exercises only with application of considerable power, but it cannot be used for rehabilitation of the delicate spinal stabilization system and core muscles.

Also document U.S. Pat. No. 3,428,325 (ATKINSON GARLAND P) is known, which describes workout device for learning proper swinging movement of the sports equipment. Its purpose is to provide a new and improved training club for training of correct swinging techniques. Another purpose is to provide practical golf club with shaft adjusted to bend in all directions laterally to its longitudinal axis.

Also document US6887188 (DAVIES PHILLIP HUGH [US]) is known, which describes a device for simulation of jumping and workout similar to aerobic. It is a pair equipment, which is in conflict with the intended use of the aid as per the invention, which is not a pair equipment.

In this document, the length of the rope from the handle base to the furthest point of the loading component is stated as a range between 254 mm and 609 mm, while the author states that more convenient length is in range between 406 and 508 mm.

On the contrary the aid as per this invention is very ineffective with length shorter than 600 mm (from the orifice of the handle to the inner edge of the loading head), because if this distance is even shorter than 550 mm, the equipment is completely ineffective.

As can be seen from the above cited documents, the crucial parameters that influence the use of the aid as per this invention for the intended purposes for rehabilitation for strengthening of the core muscles, or as the case may be for torsion and rotational movements of torso and upper limbs, while, if performed frequently, the muscles of the upper body half are strengthening, mainly the abdominals and back muscles, the weight in proportion to length of the aid, or as the case may be the weight of its individual parts, which is the loading head, handle and rope, and their mutual length proportions.

SUMMARY OF THE INVENTION

The substance of this invention is a fitness and rehabilitation aid, while the subject matter of the invention is design of the properties of its individual parts so that the most effective possible way of exercising is achieved. The invention is intended for rehabilitation for strengthening of the core muscles, mainly by torsion and rotary movements of the torso and upper limbs, with frequent exercising the body parts are shaping up and the muscles of the upper body half are strengthening, mainly the abdominals and back muscles.

The purpose of the aid as per this invention is to provide an effective device for two workout groups.

The first group is about exercising the surface muscles, which is mainly training of the muscles responsible for movement, i. e. the third layer muscles, which are activated ideally during large and quick changes of body centre of mass, for example during large movement excursions or during serious system destabilization. The third layer muscles interconnect up to 6 segments.

The second group concerns rehabilitation exercises when mainly core muscles are trained (LPHC—Lumbo Pelvic Hip Complex) which have stabilization function for the spine and also support inner organs. These are the muscles of the deepest layer, also called short intersegmental muscles, which are scattered in the paravertebral sinew, that set the position of vertebras to the required position during the mere thought, several milliseconds before commencing the movement itself. Also it concerns muscles in the second layer, where are muscles that are interconnecting four to six segments.

Strengthening of the core muscles is complicated and these days there is no equipment that would effectively and, more importantly, in a balanced manner strengthen and thus remove disbalances amongst individual groups of core muscles that cause pain in back, neck spine or hip joints and even knees. LPHC is a system that works only when all muscle groups are perfectly balanced.

Principle of the Fitness and Rehabilitation Aid:

The fitness and rehabilitation aid uses mostly the centrifugal force that takes out the body centre of mass from its natural position during workout. The brain gives an impulse to the deep stabilization system of the spine (flexing of these muscles is subconscious) and that is trying to return the destabilized body centre of mass to the original position. The result is involvement of the whole inner stabilization system.

The above mentioned goals are achieved by designing mutual configuration of the individual parts, from which the aid is consisting, so that the physical forces that affect the desired muscle parts during workout are optimally stimulated.

This is achieved by definition of the mutual ratios of weight and length of the individual parts, or as the case may be loading head, flexible connecting component and handle. The most important is the correct design of length range of the flexible connecting component and weight of the loading head.

The flexible connecting component creates a flexible connection between the loading head and the handle. The flexible connecting component is rope in particular. As a variation rope can be exchanged for another part with similar properties, e. g. cord, cable or light chain. Further in the text we use the word rope for this flexible connecting component primarily, mainly when referring to the pictures and examples of the invention implementation, but this does not prevent substitution of the rope by the above mentioned equivalents, if they have the same or similar properties as rope.

It is desirable for the aid to be available not only for adults of various height and body constitution, but also for children.

The aid as per this invention is characterized by the fact that the flexible connecting component length from the point where the flexible connecting component leaves the handle, i.e. from the handle orifice, to the point where it enters the loading head, is at least 600 mm, preferably 620 to 750 mm, more preferably 640 to 660 mm, the most preferably 650 mm.

Considering the fact that the weight of the flexible connecting component, e.g. rope, in the below stated length range is only tens of grams, this property does not have any significant influence on the moment of inertia and therefore also on the moment of momentum. Therefore, only the flexible connecting component length is important.

The optimal weight of the loading head is crucial for function of this aid. This is a thing that is, together with the flexible connecting component length, the core of this solution's function.

Regarding the other properties of the loading head, the fact that the loading head cannot be too large so that it does not limit the workout is surely obvious for an expert. In addition, it shouldn't be in a shape that would significantly influence the air resistance, so that unwanted movement and rotations don't occur.

For achieving the optimal balance, it is necessary to think about the length of the loading head, because you need to add ca. half of the length of the loading head to the formula for moment of inertia calculation from the radius of the spinning, which will consequently influence also the moment of momentum. The total length of the aid must enable the person to perform exercises described below, while the length of the loading head usually does not exceed 300 mm. Convenient length of the loading head is 120 to 200 mm and diameter 50 to 65 mm. Optimal length is 130 mm and diameter of the head is approximately 58 mm.

The subject matter aid is also designed with emphasis on compactness and the size and weight ratio.

For optimal determination of the ratios of the size and weight of the parts, it is necessary to take several variables into account, which is the height of the person, his/her physical condition and the purpose of using the aid, i. e. rehabilitation or workout.

Flexible Connecting Component Length

This invention defines, with regards to the above mentioned, the optimal flexible connecting component length in range of 620 mm to 750 mm, while the flexible connecting component cannot be shorter than 600 mm as stated above, because the efficiency on the muscles rapidly decreases with shortening the flexible connecting component below this length. The flexible connecting component length for purposes of this description is defined as distance from the handle orifice to the place, where the flexible connecting component enters the loading head. The flexible connecting component is naturally longer than the above mentioned values, but it is usually hidden in the handle and the loading head, which are components that are interconnected by the rope and are anchored to it, mainly by using locking or locking components. Further details will be described below.

Preferably, the flexible connecting component length equals 640 to 660 mm. The most optimal flexible connecting component length is 650 mm as with this flexible connecting component length the muscle groups work out optimally and at the same time both short and tall people can exercise with the equipment, which was tested on person with the shortest height 160 cm.

For more comfortable and, in case of rehabilitation, more thorough workout, the aid can be equipped with locking that will enable user to change the flexible connecting component length from the point where the flexible connecting component leaves the handle, i. e. handle orifice, to the point where it enters the loading head. The optimal range for changing the flexible connecting component length is approximately 120 mm, while the flexible connecting component cannot be shorter than 600 mm after shortening. Description of this type of locking in more detail follows below.

It was found out that for rehabilitation the flexible connecting component length is more beneficial than the weight, i. e. the longer the flexible connecting component is, the more thorough muscle exercising (stretching) is achieved. This has its limitations as even though the aid is still functional above the value of the flexible connecting component length 750 mm, it is difficult to coordinate the movement and some of the exercises cannot be performed anymore due to the length. The problem with coordination is growing together with longer flexible connecting component, generally rope. For this topic please see table 2.

The bottom limit of flexible connecting component length 600 mm has to be observed also with equipment intended for children. This fact was confirmed by users' experimental testing and this corresponds with moment of inertia of ca. 0.0702 kg·m2. See also table 2.

For illustration, exercises can be performed even with the flexible connecting component length of 450 mm, but the aid is not beneficial for the muscle groups during workout, even with higher weight of the head. This is why the minimum flexible connecting component length was set to 600 mm.

The top limit of flexible connecting component length is also limited by the base, on which the user is standing, and feasibility of the exercises itself. If the user was standing on an elevated place, theoretically, it would be possible to use longer flexible connecting component, i. e. longer than 750 mm, and the aid would not hit the ground. The top flexible connecting component length is therefore limiting mainly due to practical reasons, but as already suggested, the coordination of the exercises is significantly harder. The flexible connecting component length over 750 mm is not practical from the compactness point of view and for people of standard height the aid of such flexible connecting component length is difficult to workout with for maintaining the correct coordination.

Loading Head Weight

Regarding the loading head weight it was found out that for some exercises, and mainly for women, it is important that the bottom limit of the weight range of the loading head is approximately 250 g. If the weight was higher, muscles of the torso or arms would not be able to perform the exercise technically correct. Here we must take the above mentioned factors into consideration and check whether it is rehabilitation exercise or workout for improvement of the physical condition. The bottom limit of the weight range is most important in rehabilitation exercises. Also the physical fitness of the user, which is widely different in a non-trained and a trained person, or between man and woman. Another influencing factor is the intensity of the workout expressed by the speed of head rotation. For this topic, please see table 1.

Locking of the Flexible Connecting Component in the Handle

In order to avoid accidental release of the flexible connecting component, generally rope, the handle is equipped with locking, which must be created in such way so that it avoids twisting of the flexible connecting component so that the flexible connecting component can turn around its axis in the handle. Example of implementation of fixed locking is in FIG. 3.

For that purpose, the handle in the orifice of the flexible connecting component and/or the locking itself can be preferably equipped with a bearing, which significantly reduces friction between the flexible connecting component and the handle and thus enables free rotation of the flexible connecting component in the handle. Example of implementation of the bearing is in FIGS. 3, 4 and 5.

In another convenient implementation the locking of the flexible connecting component in the handle is created so that it enables adjustment of the length of the flexible connecting component between the loading head and the handle, therefore it is not a fixed locking but a shiftable one, i. e. it enables shiftable adjustment of the length of the flexible connecting component. Examples of shiftable locking implementation are shown in FIGS. 4 and 5.

The handle can be also equipped on its free end with a safety strip or strap, of which purpose is to catch the aid if it slips from the hand of the user, as depicted for example on FIGS. 1, 3, 4 and 5. To access the flexible connecting component stored in the handle cap can be used, e. g. fixed with bolt assembly, that can preferably fixate the strip. This implementation can be seen on FIGS. 3 to 5 and FIG. 7.

Convenient implementations of locking, further also with addition of components for adjustment of the length of the flexible connecting component, are described below.

TABLE 1

The amount of impacting centrifugal force of the head $F_o$(N) to the muscles for various levels of workout intensity, i.e. speed of head rotation v(m/s), depending on the head weight m(g) and rotation radius r(m), given by the rope length with addition of half of the head length (where the centre of mass is located). For the purposes of the calculation, rope was used as the flexible connecting component.

| Workout intensity | rotation speed v (m/s) | loading head weight m = 250 g | loading head weight m = 415 g |
|---|---|---|---|
| Low intensity | | | |
| rope length 455 mm r = 0.455 + 0.075 = 0.53 m | 3.94 m/s | 7.3 N | 12.2 N |
| rope length 650 mm r = 0.65 + 0.075 = 0.725 = 0.73 m | 4.95 m/s | 8.5 N | 14.0 N |
| rope length 845 mm r = 0.845 + 0.075 = 0.92 m | 6.15 m/s | 10.3 N | 17.1 N |
| Medium intensity | | | |
| rope length 455 mm r = 0.455 + 0.075 = 0.53 m | 5.74 m/s | 15.5 N | 25.8 N |
| rope length 650 mm r = 0.65 + 0.075 = 0.725 = 0.73 m | 7.77 m/s | 20.7 N | 34.3 N |
| rope length 845 mm r = 0.845 + 0.075 = 0.92 m | 9.63 m/s | 25.2 N | 41.8 N |
| High intensity | | | |
| rope length 455 mm r = 0.455 + 0.075 = 0.53 m | 8.32 m/s | 32.7 N | 54.2 N |
| rope length 650 mm r = 0.65 + 0.075 = 0.725 = 0.73 m | 10.92 m/s | 40.8 N | 67.8 N |
| rope length 845 mm r = 0.845 + 0.075 = 0.92 m | 12.30 m/s | 41.1 N | 68.2 N |

TABLE 2

The moment of inertia of the head I = m · r2 (kg · m2), rotating around the axis of rotation (given by the place where the handle is grasped), thus working mainly to the torso muscles during the workout, depending on the head weight m and rotation radius r (i.e. length of the flexible connecting component + ½ length of the loading head). For the purposes of the calculation, rope was used as the flexible connecting component.

| Moment of inertia I | for | loading head weight | loading head weight |
|---|---|---|---|
| for | | 0.250 kg | 0.415 kg |
| Rope length 455 mm r = 0.455 + 0.075 = 0.53 m | 0.53 m/s | 0.0702 kg · $m^2$ | 0.1166 kg · $m^2$ |
| Rope length 600 mm r = 0.600 + 0.075 = 0.725 = 0.68 m | 0.68 m/s | 0.1139 kg · $m^2$ | 0.1891 kg · $m^2$ |
| Rope length 650 mm r = 0.650 + 0.075 = 0.725 = 0.73 m | 0.73 m/s | 0.1314 kg · $m^2$ | 0.2181 kg · $m^2$ |
| Rope length 700 mm r = 0.700 + 0.075 = 0.725 = 0.78 m | 0.78 m/s | 0.1502 kg · $m^2$ | 0.2493 kg · $m^2$ |
| Rope length 845 mm r = 0.845 + 0.075 = 0.92 m | 0.92 m/s | 0.2116 kg · $m^2$ | 0.3513 kg · $m^2$ |

Regarding other properties of the flexible connecting component in the form of rope it was experimentally found that it is dangerous to workout with elastic rope or rubber. The weight has a tendency to return back to the centre of rotation, i. e. against the user, due to the elastic forces impact during the maximum stretch.

Therefore, it is convenient to use static flexible connecting component or flexible connecting component with low elasticity, as the case may be its elasticity is close to zero and equals 5% maximum.

Convenient Handle Locking Implementation

The locking of the flexible connecting component in the handle can be in case of using rope (or cord) preferably implemented with use of two and more cuts in the rope in predefined distance from each other, preferably approximately 2 to 7 cm, preferably 5 cm, to which the locking pad with outer dimensions preventing passing through the hole is inserted, by which the rope leaves the handle towards the loading head. The locking pad contains a recess that fits to the cut on the rope. Example of the implementation is shown on FIG. 5. The cuts are created by ultrasound that prevents fray. It is possible to set the length of the rope preferably in steps of 5 cm, e.g. to 65, 70 and 75 cm.

Another way of rope fixation in the handle is locking by use of locking component shown on FIG. 4, with details described on FIGS. 6*a* to 6*f*. This is the so-called shiftable locking component. This locking component enables to fixate the flexible connecting component in any position and can be used also for the loading head locking, as can be seen for example from FIG. 8*a*, 8*b* and FIG. 9. The locking component as per this implementation consists of hollow body of cylindrical shape, through which the flexible connecting component passes, and which is equipped with a recess in the longitudinal axis of the locking component on opposing walls, to which the braking part is fixated by pins placed perpendicularly to the recess axis and also to the axis of the flexible connecting component. One locking component contains at least one pair of opposing braking parts.

The braking part is equipped with braking surface, preferably equipped with rough surface, which is placed further from the hole creating the centre of rotation of the braking part, through which the pin goes, than its opposite surface, which is enabling free movement of the flexible connecting component. By rotation of the braking part for the braking surface to face the flexible connecting component the flexible connecting component is compressed in the place of locking component and thus the locking component is fixated on the flexible connecting component. The shape of the braking surface is rounded, while the braking part has its braking surface elongated from the rotation axis so that if the locking component is in locked position of the braking part, by pulling the flexible connecting component this elongated part of the braking surface will affect the braking part in the direction of the flexible connecting component movement and stronger compression of the flexible connecting component occurs. By pulling the flexible connecting component in opposite direction, the locking component can be released for adjustment of the length of the flexible connecting component.

Component(s) for Adjustment of the Flexible Connecting Component Length

Besides components that enable rope locking and adjustment of its length at the same time the rope can be also equipped with scale for rope length adjustment (not shown), mainly in case the shiftable locking component is used. The scale has to be flexible and can be preferably placed in the longitudinal cut in the rope.

Convenient Implementations of the Loading Head

The purpose of this invention is also to propose convenient solutions that improve user comfort and safety during the use of this aid. These improvements concern mainly the way of the loading head creation, its attachment to the flexible connecting component and the manner of weight placement in this loading head.

The aid as per this invention consists of the loading head, to which the flexible connecting component is attached, generally rope. The interconnection between the loading head and other equivalent flexible connecting components other than rope will be obvious to experts. In case of cord, string or chain various snap-hooks and similar connecting parts can be used that are used for connecting these parts and it is not necessary to further elaborate on them.

In case rope is the flexible connecting component, it is fixated to the locking head preferably by the locking component, which is attached to the end of the rope preferably by the method of thermoplastics injection.

For further explanation in this part of the invention, description rope is used as the flexible connecting component. It arises from the examples of implementation that other flexible connecting components can be used instead of rope.

The locking component of the loading head is preferably equipped with guiding groove that prevents locking component's rotation in the loading head in the rope axis. Also, it is equipped with half-arc recess for easy flowing around by the rope. See FIG. 2.

The loading head contains at least one hole or recess for weight placement.

In another beneficial implementation of this variation as per FIG. 2 the loading head contains multiple holes or recesses for weight placement and holes for pulling the rope through on the edges. The rope enters the loading head in the middle of the side wall of the loading head by the hole perpendicularly to the half-arc recess, which it copies further, while it surrounds the weight holes and ends in the locking component, to which it is fixated. The holes for weights can be pass-through so that the rope surrounds the holes from both sides.

In another convenient implementation, the rope can be embedded to the longitudinal grooves, that go through the holes or recesses for weight placement (not shown).

The process of fixation of the rope to the loading head is first to pull the rope through the side hole for the rope, pull the rope to the other end of the loading head, pull the rope through the other side hole for the rope, pull the rope back to the first end of the loading head, pull the rope through the first side hole for the rope longitudinally to the locking component and pull the rope out through the side hole of the loading head. This way a loop is created, which fixates the weights during exercising with the aid because the rope contracts around the weights due to the centrifugal force.

The loading head is preferably created from hard core that contains the above mentioned holes and then is equipped with soft slip-on cover that minimizes possible injuries or damages caused by loading head hit.

In a variation, for example as per FIGS. 8*a* and 8*b* the loading head consists of at least two repeatably detachable parts, while at least one of these parts can be replaced by part of the same shape with different weight, by which the total weight of the loading head can be adjusted.

These two or more parts are preferably fixated by connecting components, for example projections and recesses. In another convenient implementation the contact walls of the parts are created so that they prevent unwanted rotation in all axes, which is achieved by for example corrugation on the contact walls, as can be seen for example from FIG. 8*a* and FIG. 8*b*. Even though these pictures are just side cross-sections of the loading head, for an expert it will be obvious how to achieve the proposed spacial configuration.

In another implementation as per FIG. 9 the head is replaced as a whole by another head of different weight.

Method of Operation

The method of operation lies in performing the following exercises. This list is only illustrative and use of the aid is not limited by these exercises.

The aid can be controlled in a way that the movement trajectory of the loading head is in the direction from the top downwards, therefore the centrifugal forces are working from the back forward, i. e. in the basic movement direction. (basic)

As a variation the movement trajectory of the loading head is from the bottom upwards, therefore the centrifugal forces are working from the front rearwards, the so-called reverse movement direction. (reverse)

All below mentioned exercises can be controlled in the basic or reverse movement direction or in their combination.

If the centrifugal forces work from the back forward, different muscle parts are working than in the case of the forces working rearwards.

The method of operation is not limited in time, but it is convenient to perform the individual exercises for approximately 30 seconds.

Variation 1

The method of operation as per variation 1 shown on FIG. 10*a* consists of the following steps:

- set the body in a wide stance, shoulder breadth, face facing forward, chin slightly up;
- grasp the handle with palms facing you in the waist level;
- perform the rotation with the aid so that the loading head moves in the shape of an eight, while your arms are stretched, hips and wrists are static and the exercise is done by the torso movement with no movement of wrists and/or arms;
- variation for rehabilitation workout consists of limitation of the torso movement to the limit of 12 degrees each side with use of lower loading head weight and longer flexible connecting component.

Variation 2

The method of operation as per variation 2 shown on FIG. 10*b*, which is suitable for people with sedentary jobs and those who experience pain and pressure in the lumbar area, consists of the following steps:

- set the body in a wide stance, shoulder breadth, face facing forward, chin slightly up;
- grasp the handle with palms facing you in the waist level;
- perform the rotation with the aid so that the loading head moves in the shape of eight
- gradually raise the arms up to position above head, while in the position of arms above head only torso lean is performed to the sides, in the direction of the loading head passing-through.
- variation step to be used in case of problems with lumbar spine is to choose flexible connecting component longer than 700 mm and only in reverse movement direction.

Variation 3

The method of operation as per variation 3 shown on FIG. 10*c* consists of the following steps:

- set the body in a wide stance, shoulder breadth, face facing forward, chin slightly up;
- grasp the handle with palms facing you in the chest level;
- circle the aid in front of the body while stretched arms are moving in a circle of approximately 50 cm in diameter, while hips, wrists and shoulders are static;
- due to balanced load on the muscles the direction of the rotation is changed and when the direction of the rotation is changed, also the hands grasp on the handle is changed, while torso muscles are flexed and are coordinating the movement;

in variation for rehabilitation workout loading head with the lowest weight is used.

Variation 4

The method of operation as per variation 4 shown on FIG. 10*d* consists of the following steps:

set the body in a wide stance, shoulder breadth, face facing forward, chin slightly up;

grasp the handle with one hand, palm facing down with stretched arm, while the free hand is on your chest;

rotate the aid in the shoulder join so that the arm moves in a circle with approximate diameter of 50 cm, while arms are stretched, hips and wrists are static and shoulder blades are contracting towards each other.

variation step consists of rotating the body to 45 degrees against the arm to stretch the chest;

another variation step consists of moving the arms to both sides.

another variation step consists of flexing the torso muscles more intensively on the opposite side from the weight.

Variation 5

The method of operation as per variation 5 shown on FIG. 10*e* consists of the following steps:

set the body in a wide stance, shoulder breadth, face facing forward, chin slightly up;

grasp the handle with palms facing you in the chest level;

rotate the aid so that the loading head moves in the shape of an eight, while in the left and right edge position the loading head spins a whole revolution, while on the side, where the revolution occurs, knee is slightly bent and the opposite leg slightly raises the heel with consequent using of the hip joints while arms are stretched, hips and wrists are static and the exercise is performed by the torso movement with exclusion of wrist and/or arm movement;

variation step for rehabilitation workout is to limit the torso movement to the limit of 10 degrees on each side.

Variation 6

The method of operation as per variation 6 shown on FIG. 10*f* consists of the following steps:

set the body in a wide stance, shoulder breadth, face facing forward, chin slightly up;

choose the shortest possible length of the flexible connecting component;

grasp the handle with palms facing you in the chest level;

rotate the aid so that the loading head moves in the shape of an eight, while wrist is static and the exercise is performed with no torso movement, while on the side where the head passes through the elbow is pushed as far to the back as possible and an imaginary circle is performed by the elbow.

variation step is to perform the movement only in the basic direction.

Variation 7

The method of operation as per variation 7 shown on FIG. 10*g* consists of the following steps:

set the body in a wide stance, shoulder breadth, face facing forward, chin slightly up;

grasp the handle with palms facing you;

rotate the aid above the head so that torso rotates in an imaginary funnel shape while wrist moves in a circle of diameter approximately 50 cm, while wrist is static and the exercise is performed by the torso without any arm movement;

variation step for balanced load on the muscles is to perform the exercise in both directions, while you change the hand on the handle during change of rotation direction;

another variation step designed for rehabilitation purposes is to deflect the torso from the body axis in the maximum angle of 4 degrees and use the lowest loading head weight.

Variation 8

The method of operation as per variation 8 shown on FIG. 10*h* consists of the following steps:

set the body in a wide stance, shoulder breadth, face facing forward, chin slightly up;

grasp the handle with palms facing you in the chest level;

rotate the aid so that the imaginary ellipsis created by the movement of the loading head proceeds in the opposite direction between lower and upper limbs, therefore askew from the body axis, while the opposite leg is always put slightly forward, while the shoulder and elbow joints are in movement and the torsal movement of the torso is in the range of ca. 22 degrees.

OVERVIEW OF THE FIGURES

Figure 6A:
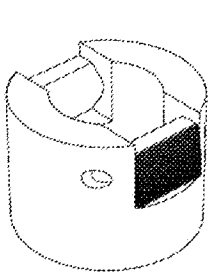
Figure 6B:
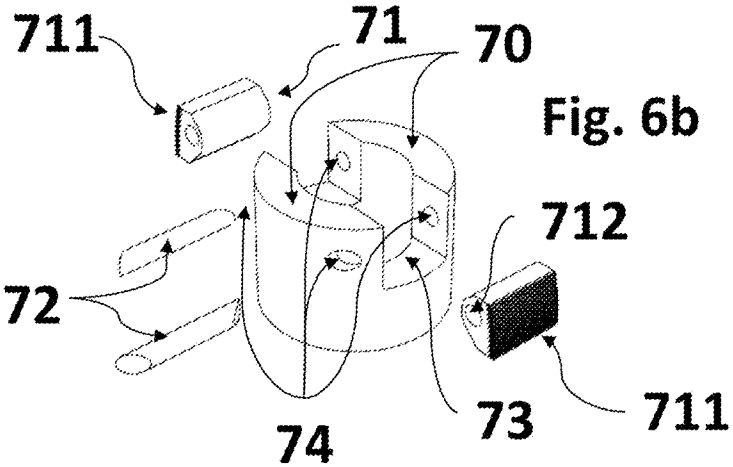

FIG. 6*a* shows axonometric view of the locking component for smooth rope length adjustment;

FIG. 6*b* shows dismantled view of the set of components that are contained in the locking component as per FIG. 6*a;*

Figure 6C:
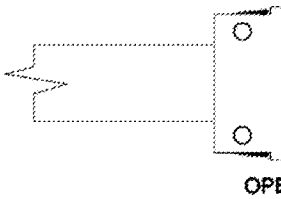
Figure 6D:
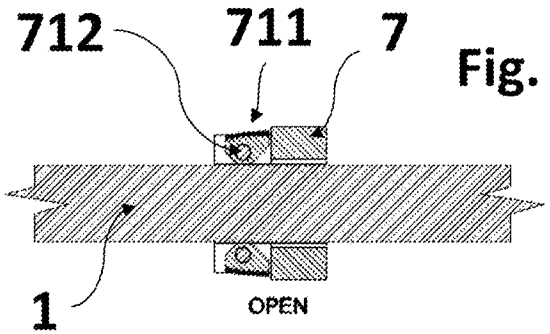

FIG. 6*c* shows cross-section of the locking component as per FIG. 6*a* in open position, when the braking parts enable free movement of the rope;

FIG. 6*d* shows cross-section of the locking component as per FIG. 6*c*.

Figure 6E:
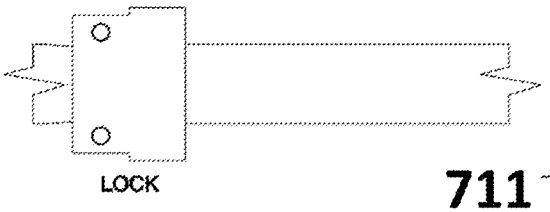
Figure 6F:
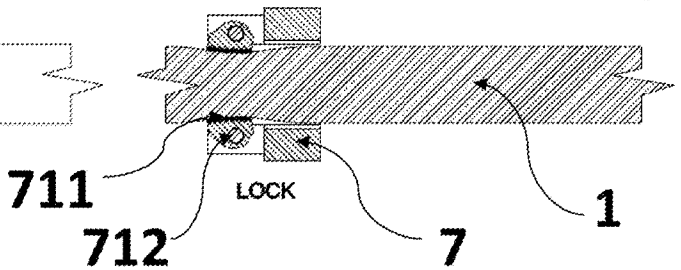

FIG. 6*e* shows cross-section of the locking component as per FIG. 6*a* in locked position, when the braking parts are fixating the rope;

FIG. 6*f* shows cross-section of the locking component as per FIG. 6*e*.

Figure 7:
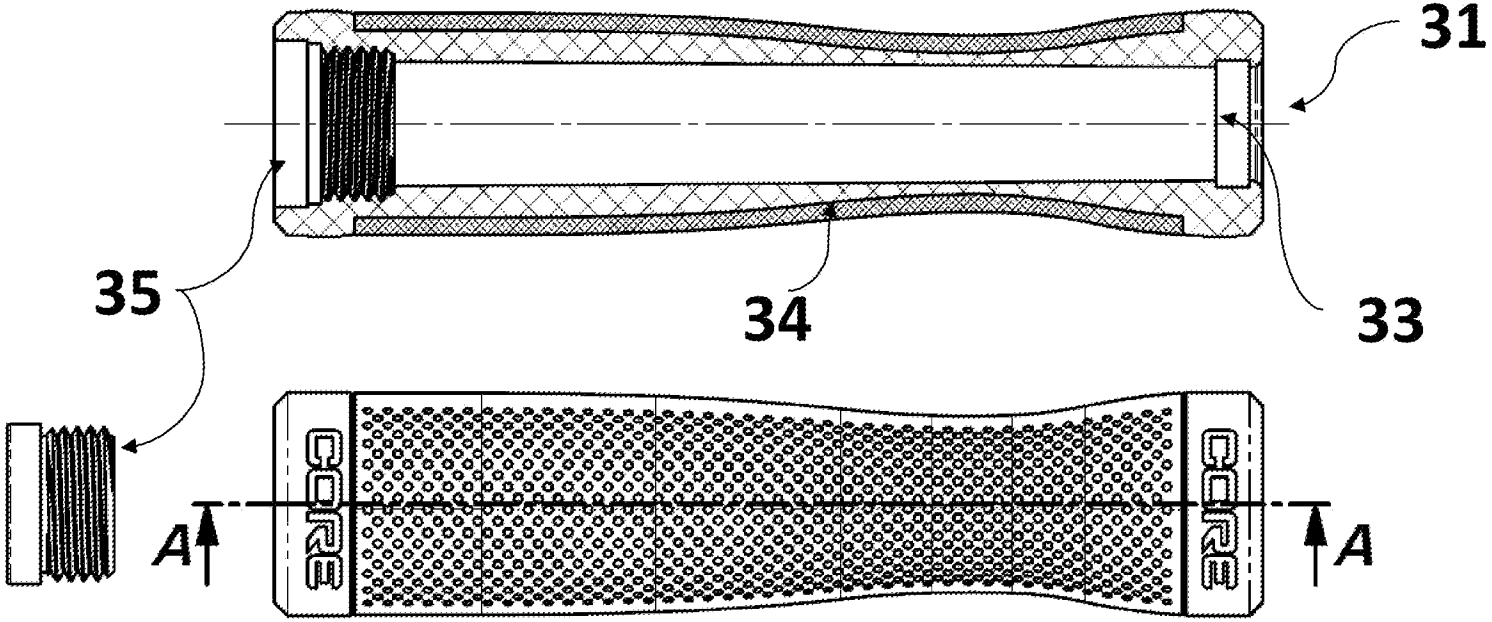
Figure 8A:
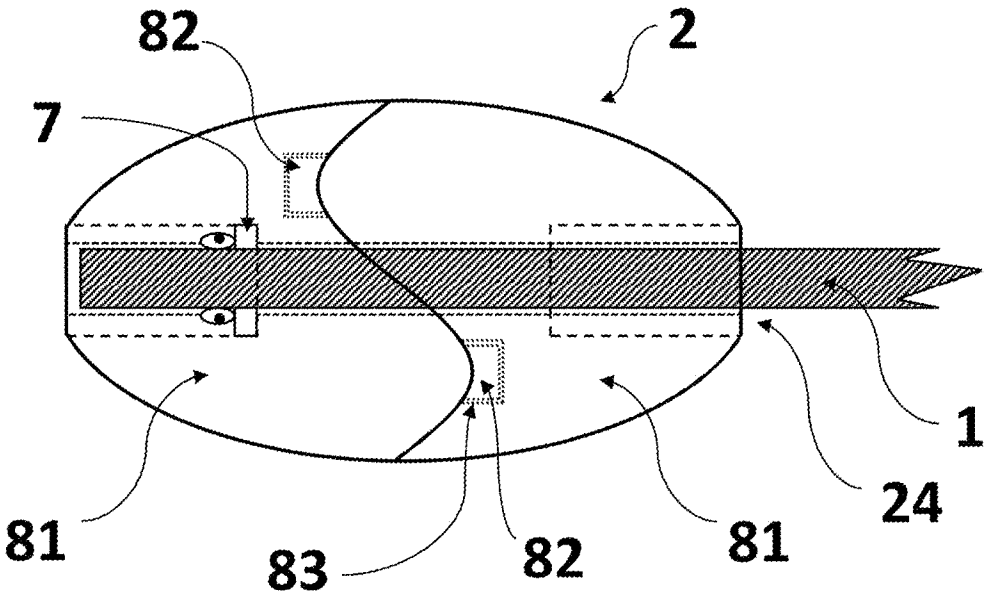
Figure 8B:
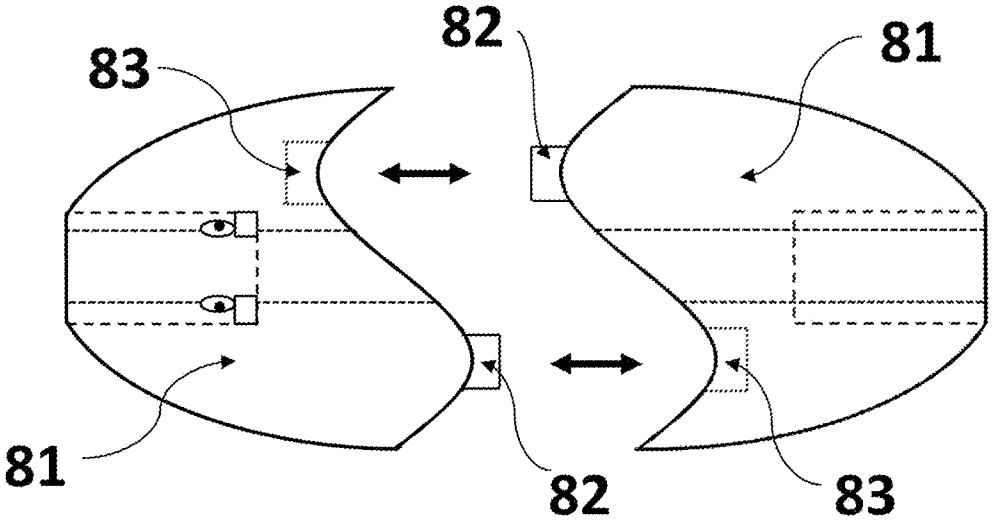
Figure 9:
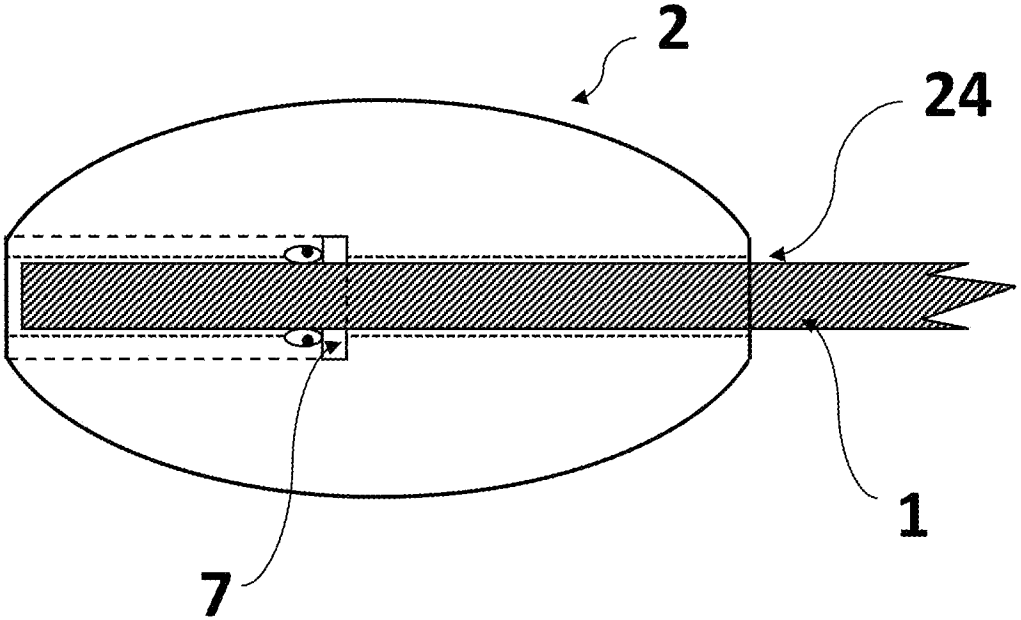
Figure 10B:
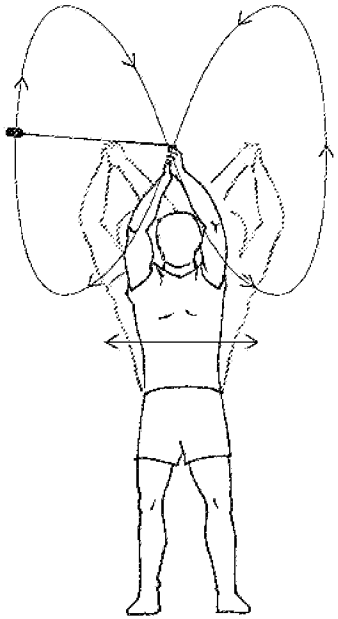
Figure 10A:
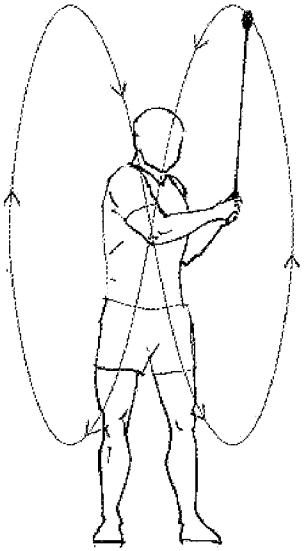
Figure 10C:
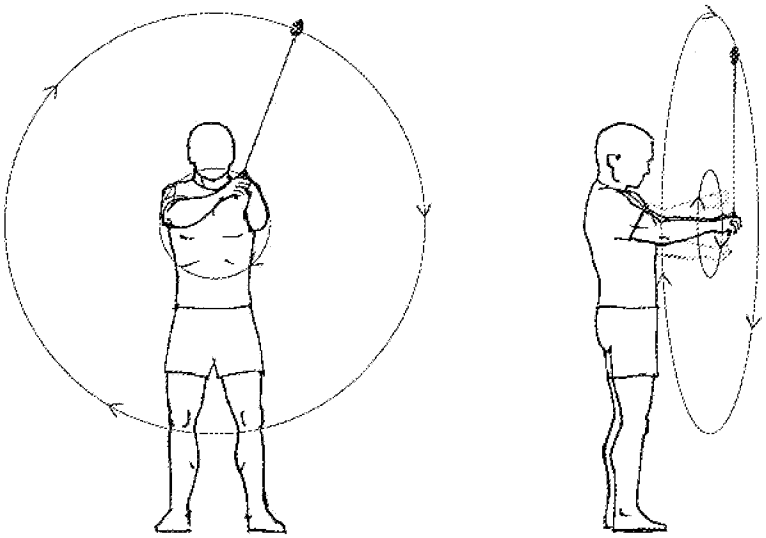
Figure 10D:
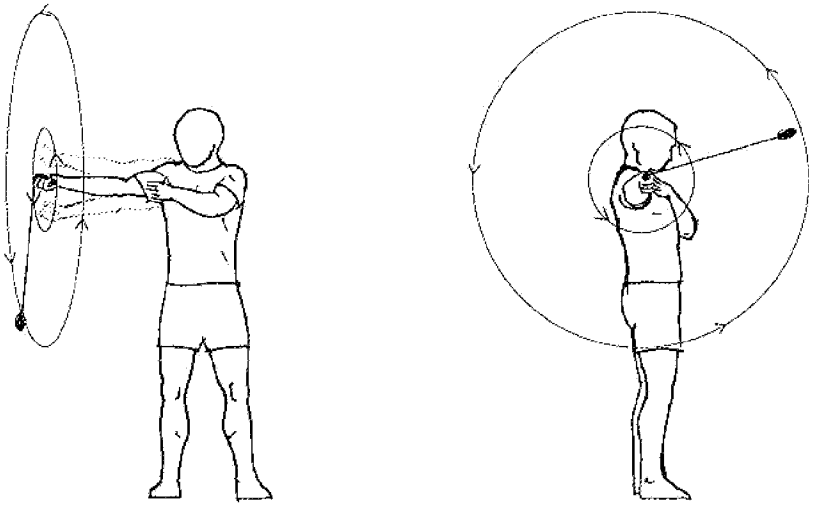
Figure 10E:
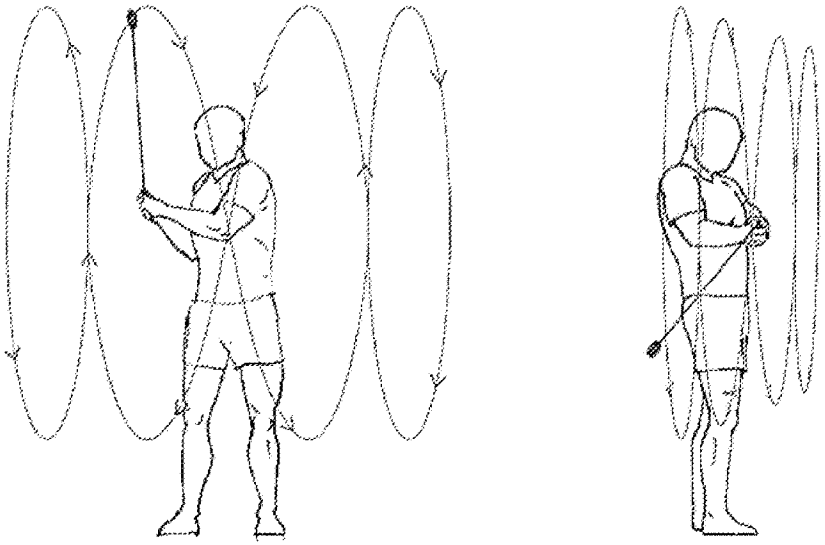
Figure 10F:
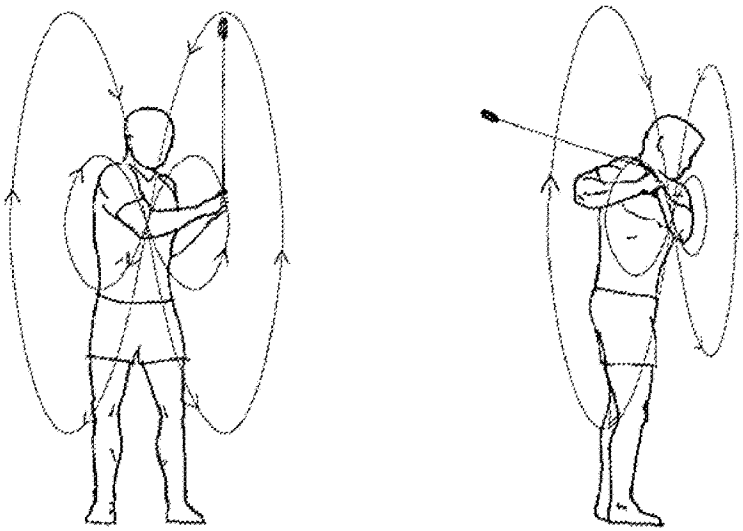
Figure 10G:
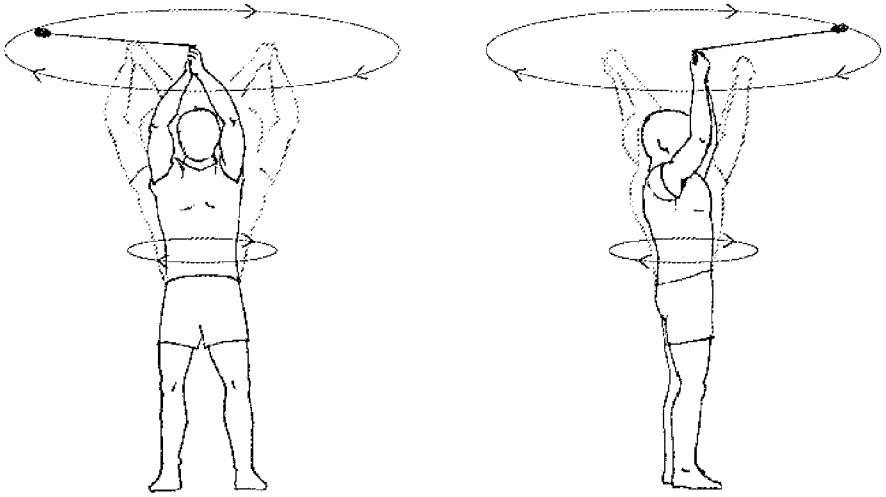
Figure 10H:
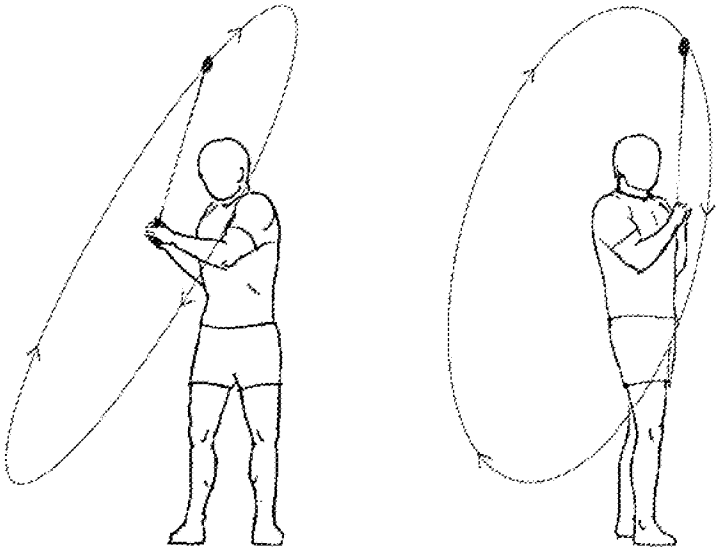

FIG. 7 shows cross-section and A-A section of convenient variation of implementation of the handle with ergonomic shape in aspect ratio of the real product;

FIG. 8*a* shows variation of implementation of the loading head in cross-section, consisting of two interconnected parts, complementary in shape;

FIG. 8*b* shows variation of implementation of the loading head as per FIG. 8*a* in cross-section consisting of two disconnected parts, complementary in shape;

FIG. 9 shows variation of implementation of the loading head consisting of one part and equipped with shiftable locking component;

FIG. 10*a* shows operation scheme of the aid as per variation 1;

FIG. 10*b* shows operation scheme of the aid as per variation 2;

FIG. 10*c* shows operation scheme of the aid as per variation 3;

FIG. 10*d* shows operation scheme of the aid as per variation 4;

FIG. 10*e* shows operation scheme of the aid as per variation 5;

FIG. 10*f* shows operation scheme of the aid as per variation 6;

FIG. 10*g* shows operation scheme of the aid as per variation 7;

FIG. 10*h* shows operation scheme of the aid as per variation 8;

EXAMPLES OF INVENTION IMPLEMENTATION

Example 1

Figure 1:
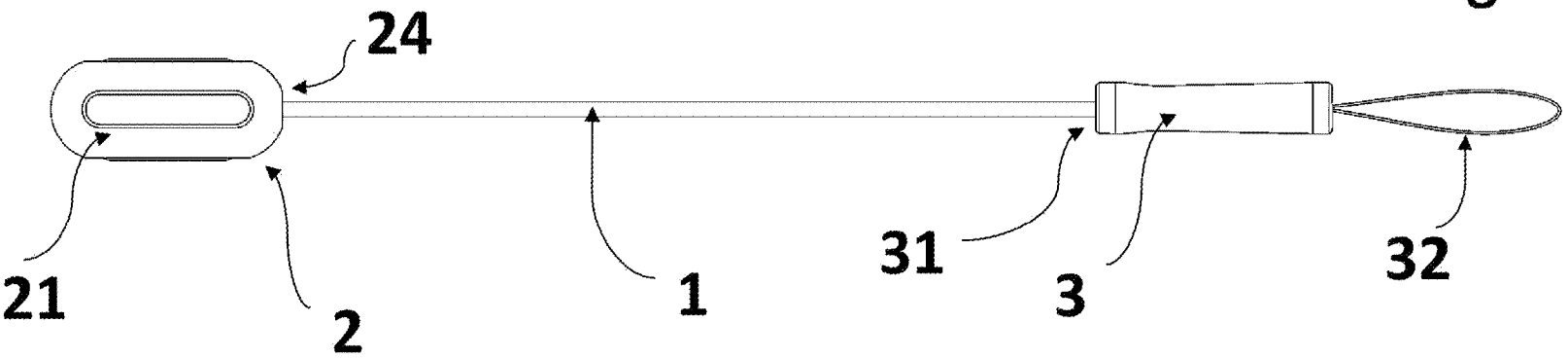
FIG. 1 shows side view of the aid as per this invention.

Fitness and rehabilitation aid as per FIG. 1, using mostly centrifugal forces that are taking the body centre of mass from its natural position while the mutual configuration of the individual components, of which the aid is consisted of, optimally stimulates the desired muscle parts, while the aid consists of the loading head 2 for achieving the desired centrifugal force and handle 3 for grasping by the user, while loading head 2 and handle 3 are interconnected by the flexible connecting component 1, generally rope, while the length of the flexible connecting component 1 from point where the flexible connecting component 1 leaves the handle 2, i. e. from the orifice 31 of the handle, to the point where it enters the loading head 2, i. e. the hole 24 for inserting the connecting component 1 to the loading head 2, equals at least 600 mm, preferably 620 to 750 mm, more preferably 640 to 660 mm, most preferably 650 mm.

In the given example the flexible connecting component 1 length equals the most beneficial 650 mm. Length of the loading head 2 equals 120 to 200 mm and diameter is 50 to 65 mm, in the given example it equals the most convenient 130 mm and the diameter of the head 2 is approximately 58 mm. The weight of the loading head 2 equals at least 250 g and does not exceed 600 g, preferably the weight of the loading head 2 equals 450 g maximum and in the given example the weight of the loading head 2 equals 350 g.

Example 2

Figure 3:
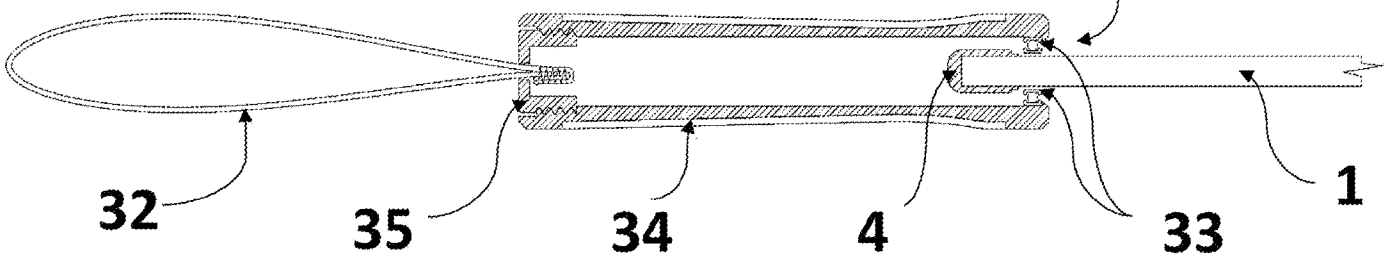
FIG. 3 shows cross-section of the handle that contains fixed locking.

Aid as per example 1, that is, in order to prevent accidental release of the flexible connecting component 1, generally rope, equipped with fixed locking 4 of the flexible connecting component 1 in the handle 3, while the implementation of the fixed locking 4 is shown on FIG. 3.

Example 3

Figure 4:
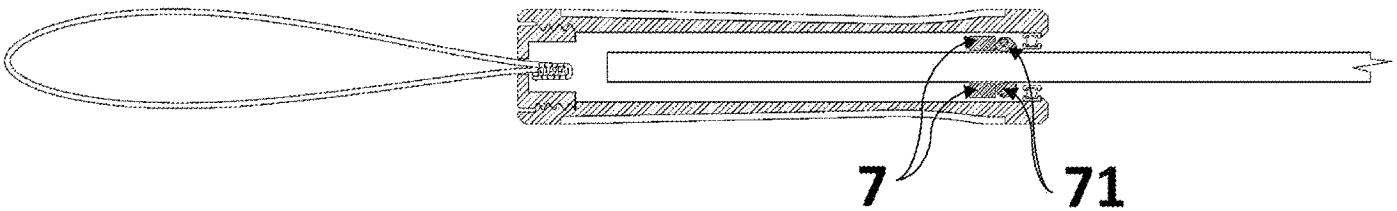
FIG. 4 shows cross-section of the handle that contains the shiftable locking for smooth adjustment of the rope length.
Figure 5:
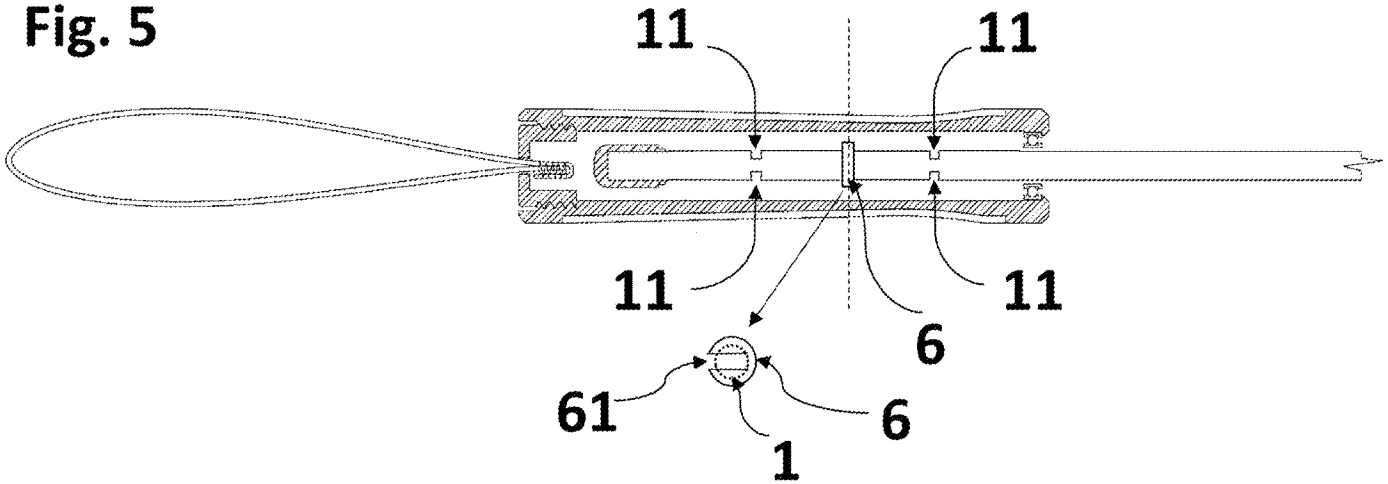
FIG. 5 shows cross-section of the handle that contains locking pad in combination with rope cuts, which enables tiered adjustment of the rope length.

Aid as per example 1 or 2, in which as per convenient implementation the handle 3 in the orifice 31 of the flexible connecting component and/or the locking 4 itself is preferably equipped with a bearing 33, which significantly reduces the friction between the flexible connecting component 1 and the handle 3 and therefore promotes the free rotation of the flexible connecting component 1 in handle 3. Example of implementation of the bearing 33 is in FIGS. 3, 4 and 5.

Example 4

Aid as per any of examples 1 to 3 with the difference that for more comfortable and, in case of rehabilitation, more thorough workout the loading head 2 and/or handle 3 is equipped with shiftable locking for adjustment of the flexible connecting component 1 length from the point, where the flexible connecting component leaves the handle, i. e. from the handle orifice, to the point, where it enters the loading head 2. The optimal range in which it is possible to adjust the flexible connecting component length is approximately 120 mm, while the flexible connecting component cannot be shorter than 600 mm in the above-defined section. Examples of implementation of shiftable locking in the handle are in FIGS. 4 and 5. Example of implementation of shiftable locking in the loading head is in FIGS. 8*a*, 8*b* and 9. Example of variation of implementation of shiftable locking is in FIGS. 6*a* to 6*f*.

Example 5

Aid as per example 4 where locking is the shiftable locking component 7, which is described in detail in FIGS. 6*a* to 6*f*. This locking component enables to fixate the flexible connecting component, generally rope, in any position and can be used also for the loading head locking 2, as can be seen for example from FIG. 8*a*, 8*b* and FIG. 9. The locking component 7 as per this implementation consists of hollow body 70 of cylindrical shape, through which the flexible connecting component 1 passes, and which is equipped with a recess 73 in the longitudinal axis of the locking component 7 on the opposite walls, to which the braking part 71 is fixated by pin 72 set perpendicularly to the recess 73 axis and also to the axis of the flexible connecting component 1. One locking component contains at least one pair of opposing braking parts 71.

The braking part 71 is equipped with braking surface 711, preferably equipped with rough surface, which is further from the hole 712 creating the centre of mass of the rotation of the braking part 71, through which the pin 72 goes, than its opposite surface enabling free movement of the flexible connecting component 1. By rotating, the braking part 71 for the braking surface 711 to face the flexible connecting component 1 the flexible connecting component 1 is compressed in the place of locking component 7 and thus the locking component 7 is fixated on the flexible connecting component 1. The shape of the braking surface 711 is rounded, while the braking part 71 has its braking surface 711 elongated from the rotation axis so that if the locking component 7 is in locked position of the braking part 71, by pulling the flexible connecting component 1 this elongated part of the braking surface 711 will affect the braking part 71 in the direction of the flexible connecting component 1 movement and stronger compression of the flexible connecting component 1 occurs. By pulling the flexible connecting component 1 in the opposite direction, release of the locking component 71 can occur for the purpose of adjustment of the flexible connecting component 1 length.

Example 6

Aid as per any of the examples 1 to 5 where the flexible connecting component 1 is rope or cord.

Example 7

Aid as per example 6 where rope or cord contain flexible scale for adjustment of the length of the flexible connecting component 1 and the scale is preferably inserted into a longitudinal cut in the rope or cord.

Example 8

Aid as per examples 4, 6 or 7, where locking of the flexible connecting component 1 in the handle 3 is in case of using rope or cord preferably implemented with use of two and more cuts 11 in the flexible connecting component 1 in predefined distance, preferably approximately 2 to 7 cm, preferably 5 cm, to which the locking pad 6 with outer dimensions preventing passing through the hole 31 is inserted, by which the flexible connecting component 1 leaves the handle 3 in the direction towards the loading head 2. The locking pad 6 contains a recess (61) that fits into the cut 11 on the flexible connecting component 1. Example of the implementation is shown on FIG. 5. The cuts are created by ultrasound that prevents fray. As per this example the adjustment of the length of the flexible connecting component 1 is achieved by use of three cuts 11 in the above defined section created by hole 24 and hole 31 on 65, 70 and 75 cm.

Example 9

Aid as per any of the examples 1 to 8, where the handle is equipped with safety strip or strap on its free end, as shown for example on FIGS. 1, 3, 4 and 5. Its purpose is to catch the aid in case it slips from the user's hand.

Example 10

Aid as per any of the examples 1 to 9, where the handle is equipped with a cap 35 for attachment of the strip or strap and/or for access to the flexible connecting component 1 in the handle 3, which is per this example fastened by bolt assembly. Implementation can be seen on FIGS. 3 to 5 and FIG. July Example 11

Aid as per any of the examples 1 to 10 where the flexible connecting component 1 is static or with low elasticity, as the case may be its elasticity is close to zero and equals 5% maximum.

Example 12

Figure 2:
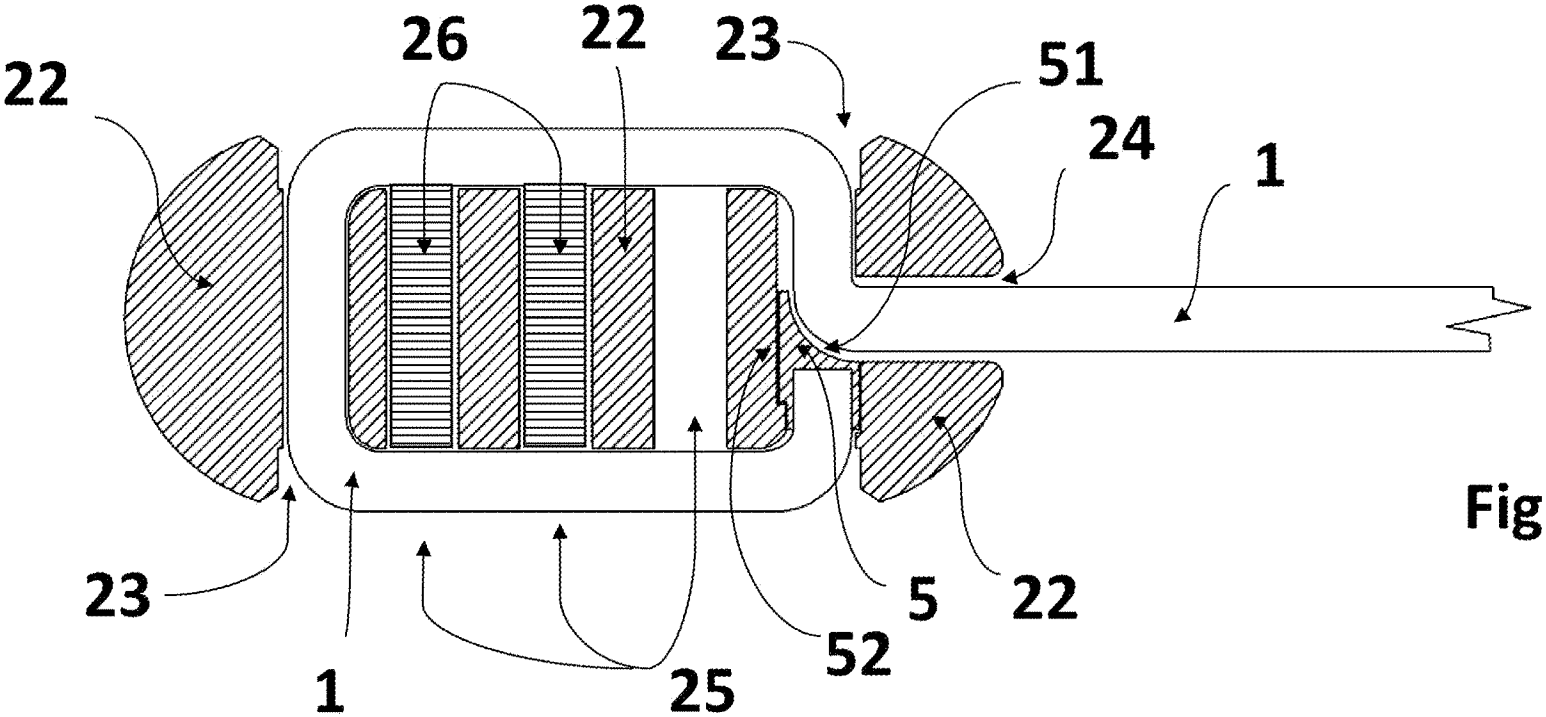
FIG. 2 shows details of the cross-section of the loading head, which contains the weights and rope fixated to the head by the locking component.

Aid as per any of the examples 1 to 11, where the flexible connecting component 1 is fixated to the loading head 2 with use of locking component of the loading head 5. As per this example where rope is used as the flexible connecting component 1, the locking component 5 is preferably fastened by the method of thermoplastics injection. Locking component 5 is preferably equipped with guiding groove 52, which prevents rotation of the locking component 5 in the loading head 2 in the axis of flexible connecting component 1. The locking component 5 is also preferably equipped with half-arc shaped recess 51 for the locking component 5 to be easily flown around by the flexible connecting component 1. See FIG. 2.

The loading head 2 preferably contains at least one hole 25 or recess for weight 26 placement. As per example in FIG. 2 the loading head 2 contains three holes 25 and on the edges the loading head 2 contains holes 23 for pulling the flexible connecting component 1 through. The flexible connecting component 1 enters the loading head 2 in the middle of the side wall of the loading head 2 by the hole 24 in the longitudinal axis of the loading head 2, copies the half-arc recess 51 while it surrounds the weight holes 25 and ends in the locking component 5, to which it is fixated, for example the above mentioned way.

The holes 25 for weights can be pass-through so that the flexible connecting component 1 surrounds the holes 25 from both sides.

The process of fixation of the flexible connecting component 1 to the loading head 2 is first to pull the flexible connecting component 1 through the side hole 23, pull the flexible connecting component 1 to the other end of the loading head 2, pull the flexible connecting component 1 through the other side hole 23, pull the flexible connecting component 1 back to the first end of the loading head 2, pull the flexible connecting component through the first side hole 23 longitudinally to the locking component 5 and pull the flexible connecting component 1 out through the side hole 24 of the loading head 2. This way a loop is created, which fixates the weights 26 during workout with the aid, because the flexible connecting component 1 contracts around the weights 26 due to the centrifugal force.

Example 13

Aid as per example 12, where the flexible connecting component 1 is embedded into longitudinal grooves that go through holes 25 or recesses for weight placement 26 (not shown).

Example 14

Aid as per any of the examples 1 to 13 where loading head is preferably created from hard core, that contains the above mentioned holes (23, 24) and then is equipped with soft slip-on cover 21, that minimizes possible injuries or damages caused by loading head hit.

Example 15

Aid as per any of the examples 1 to 11 where in alternate implementation, e.g. as per FIGS. 8*a* and 8*b*, the loading head 2 consists of at least two repeatably detachable parts 81 where at least one of these parts 81 can be replaced by part of same shape with different weight, by which the total weight of the loading head can be adjusted.

Example 16

Aid as per example 15 where two or more parts 81 of the loading head 2 are fixated by connecting components 82, 83, for example in the form of projections and recesses. Preferably the contacting walls of the parts 81 are created so that they prevent unwanted rotation in all axes, which is achieved by for example corrugation of the contacting walls, as can be seen for example from FIG. 8*a* and FIG. 8*b*.

Example 17

Aid as per any of the examples 1 to 11 where loading head 2 is temporarily connected with the flexible connecting component 1 for replacement of one loading head of particular weight by other loading head of different weight.

Example 18

The method of operation as per variation 1 shown on FIG. 10*a* consists of the following steps:

- set the body in a wide stance, shoulder breadth, face facing forward, chin slightly up;
- grasp the handle with palms facing you in the waist level;

perform the rotation with the aid so that the loading head moves in the shape of an eight, while your arms are stretched, hips and wrists are static and the exercise is done by the torso movement with no movement of wrists and/or arms;

variation for rehabilitation workout consists of limitation of the torso movement to the limit of 10 degrees each side with use of lower loading head weight and longer flexible connecting component.

Example 19

The method of operation as per variation 2 shown on FIG. 10*b*, which is suitable for people with sedentary jobs and those who experience pain and pressure in the lumbar area, consists of the following steps:

set the body in a wide stance, shoulder breadth, face facing forward, chin slightly up;

grasp the handle with palms facing you in the waist level;

perform the rotation with the aid so that the loading head moves in the shape of eight gradually raise the arms up to position above head, while in the position of arms above head only torso lean is performed to the sides, in the direction of the loading head passing-through.

variation step to be used in case of problems with lumbar spine is to choose flexible connecting component longer than 700 mm and only in reverse movement direction.

Example 20

The method of operation as per variation 3 shown on FIG. 10*c* consists of the following steps:

set the body in a wide stance, shoulder breadth, face facing forward, chin slightly up;

grasp the handle with palms facing you in the chest level;

circle the aid in front of the body while stretched arms are moving in a circle of approximately 50 cm in diameter, while hips, wrists and shoulders are static;

due to balanced load on the muscles the direction of the rotation is changed and when the direction of the rotation is changed, also the hands grasp on the handle is changed, while torso muscles are flexed and are coordinating the movement;

in variation for rehabilitation workout loading head with the lowest weight is used.

Example 21

The method of operation as per variation 4 shown on FIG. 10*d* consists of the following steps:

set the body in a wide stance, shoulder breadth, face facing forward, chin slightly up;

grasp the handle with one hand, palm facing down with stretched arm, while the free hand is on your chest;

rotate the aid in the shoulder join so that the arm moves in a circle with approximate diameter of 50 cm, while arms are stretched, hips and wrists are static and shoulder blades are contracting towards each other.

variation step consists of rotating the body to 45 degrees against the arm to stretch the chest;

another variation step consists of moving the arms to both sides.

another variation step consists of flexing the torso muscles more intensively on the opposite side from the weight.

Example 22

The method of operation as per variation 5 shown on FIG. 10*e* consists of the following steps:

set the body in a wide stance, shoulder breadth, face facing forward, chin slightly up;

grasp the handle with palms facing you in the chest level;

rotate the aid so that the loading head moves in the shape of an eight, while in the left and right edge position the loading head spins a whole revolution, while on the side, where the revolution occurs, knee is slightly bent and the opposite leg slightly raises the heel with consequent using of the hip joints while arms are stretched, hips and wrists are static and the exercise is performed by the torso movement with exclusion of wrist and/or arm movement;

variation step for rehabilitation workout is to limit the torso movement to the limit of 10 degrees on each side.

Example 23

The method of operation as per variation 6 shown on FIG. 10*f* consists of the following steps:

set the body in a wide stance, shoulder breadth, face facing forward, chin slightly up;

choose the shortest possible length of the flexible connecting component;

grasp the handle with palms facing you in the chest level;

rotate the aid so that the loading head moves in the shape of an eight, while wrist is static and the exercise is performed with no torso movement, while on the side where the head passes through the elbow is pushed as far to the back as possible and an imaginary circle is performed by the elbow.

variation step is to perform the movement only in the basic direction.

Example 24

The method of operation as per variation 7 shown on FIG. 10*g* consists of the following steps:

set the body in a wide stance, shoulder breadth, face facing forward, chin slightly up;

grasp the handle with palms facing you;

rotate the aid above the head so that torso rotates in an imaginary funnel shape while wrist moves in a circle of diameter approximately 50 cm, while wrist is static and the exercise is performed by the torso without any arm movement;

variation step for balanced load on the muscles is to perform the exercise in both directions, while you change the hand on the handle during change of rotation direction;

another variation step designed for rehabilitation purposes is to deflect the torso from the body axis in maximal angle of degrees and use the lowest loading head weight.

Example 25

The method of operation as per variation 8 shown on FIG. 10*h* consists of the following steps:

set the body in a wide stance, shoulder breadth, face facing forward, chin slightly up;

grasp the handle with palms facing you in the chest level;

rotate the aid so that the imaginary ellipsis created by the movement of the loading head proceeds in the opposite direction between lower and upper limbs, therefore askew from the body axis, while the opposite leg is always put slightly forward, while the shoulder and elbow joints are in movement and the torsal movement of the torso is in the range of ca. 22 degrees.

INDUSTRIAL UTILIZATION

The invention is usable in industry mainly in the sports field as an aid for workout and body parts shaping. It is also usable for rehabilitation after injuries, surgeries, muscle damage and neurological issues.

LIST OF REFERENCE MARKS

1—flexible connecting component
11—cut
2—loading head
21—loading head cover
22—loading head body
23—edge hole for flexible connecting component
24—hole for flexible connecting component entering the loading head
25—weight hole
26—weight
3—handle
31—hole for flexible connecting component entering the handle
32—strip
33—bearing
34—coat
35—cap
4—fixed locking component
5—loading head locking component
51—recess
52—guiding groove
6—locking pad
61—recess
7—shiftable locking component
70—hollow body of the locking component
71—braking part
711—braking surface
712—braking part hole
72—pin
73—recess
74—hole for pin of the locking component's hollow body pin
81—detachable part of the loading head
82—connecting component
83—connecting component

What is claimed is:

1. A fitness and rehabilitation aid configured to use centrifugal forces to take a body center of mass of a user away from a first position in order to optimally stimulate desired muscle parts of a user, the fitness and rehabilitation aid comprising:

a loading head having a body and configured for achieving a desired centrifugal force;

a handle configured for grasping by the user; and a flexible connecting element that interconnects the loading head and the handle;

wherein:

a length of the flexible connecting element between an orifice of the handle and a hole for inserting the connecting element to the loading head is at least 600 mm;

a weight of the loading head is at least 250 g and does not exceed 600 g;

the loading head is adapted for holding replaceable weights and contains at least one hole or recess for weights placement;

the at least one hole or recess for weights placement is a pass-through in the body of the loading head;

the flexible connecting element surrounds the at least one hole or recess for weights placement from opposing sides thereof and the flexible connecting element contracts around the replaceable weights due to the desired centrifugal force; and the flexible connecting element is embedded into lengthwise grooves that go through the at least one hole or recess for weights placement.

2. The fitness and rehabilitation aid according to claim 1, wherein the length of the flexible connecting element is between 640 to 660 mm.

3. The fitness and rehabilitation aid according to claim 1, wherein the weight of the loading head is up to 450 g.

4. The fitness and rehabilitation aid according to claim 1, wherein a length of the loading head is from 120 to 200 mm and a diameter of the loading head is from 50 to 65 mm.

5. The fitness and rehabilitation aid according to claim 1, wherein:

the loading head contains holes on edges of the loading head for pulling the flexible connecting element therethrough; and the flexible connecting element enters the loading head in a middle of a side wall of the loading head by a further hole in a longitudinal axis of the loading head, follows a half-arc recess of a locking element and surrounds the at least one hole or recess for weights placement and ends in the locking element.

6. The fitness and rehabilitation aid according to claim 1, wherein:

the body of the loading head is created from a hard core that contains holes; and a soft slip-on cover is attached to the body that minimizes possible injuries or damages caused by a hit from the loading head.

7. The fitness and rehabilitation aid according to claim 1, wherein:

the loading head comprises at least two repeatedly detachable parts; and at least one of the at least two repeatedly detachable parts is replaceable by a part of a same shape with a different weight.

* * * * *